United States Patent [19]

Beckers

[11] 3,930,353

[45] Jan. 6, 1976

[54] APPARATUS FOR CLOSING AND SEALING CONTAINERS WITH A LID

[75] Inventor: Hans Beckers, Rheydt, Germany

[73] Assignee: Robert Bosch G.m.b.H., Stuttgart, Germany

[22] Filed: Apr. 30, 1974

[21] Appl. No.: 465,497

[30] Foreign Application Priority Data

May 7, 1973 Germany ..... 2322977

[52] U.S. Cl. ..... 53/306; 53/367

[51] Int. Cl.[2] ..... B65B 7/28

[58] Field of Search ..... 53/329, 342, 306, 307, 53/367, 308, 373, 39, 334

[56] References Cited

UNITED STATES PATENTS

| | | | |
|---|---|---|---|
| 891,511 | 6/1908 | Weissenthanner | 53/334 |
| 1,860,954 | 5/1932 | Risser | 53/342 X |
| 3,060,652 | 10/1962 | Eckman | 53/39 X |
| 3,511,025 | 5/1970 | Newport | 53/307 |
| 3,752,387 | 8/1973 | Arfert | 53/329 X |

*Primary Examiner*—Travis S. McGehee
*Assistant Examiner*—Horace M. Culver
*Attorney, Agent, or Firm*—Edwin E. Greigg

[57] ABSTRACT

An apparatus for closing and sealing filled containers with a lid includes instrumentalities for positioning an individual lid beneath a sealing die which has an underside. The lid is temporarily held and finally joined to a container under the influence of heat and pressure. Suction is used to hold the lid against the underside of the die while it is being joined to the container. A plurality of protuberances are disposed at the underside of the sealing die. Each of the protuberances has an oblique surface. Each oblique surface has a point lying nearest a sealing surface defining an area of the underside, the area thus defined being substantially equal to that of the lid. Each lid can be consequently positioned correctly on a container and becomes fused therewith.

9 Claims, 2 Drawing Figures

APPARATUS FOR CLOSING AND SEALING CONTAINERS WITH A LID

BACKGROUND OF THE INVENTION

This invention relates to an apparatus for closing and sealing filled containers with a lid. The invention relates, more particularly, to an improvement in an apparatus for closing and sealing filled containers using preformed lids in which, for each container, a lid is moved beneath a sealing die, is temporarily held against its bottom by a vacuum, and is finally joined to a container under the influence of pressure and heat.

In an apparatus for closing and sealing of the kind mentioned above, for example, the apparatus made known by the German Offenlegungsschrift (Laid Open Patent Application) No. 1,909,792, a lid is brought to the underside of a sealing die, it is sucked against it by vacuum, and then the sealing die presses the lid onto the container positioned beneath it. In this known apparatus, the lids are brought to the sealing die in the correct position by a pair of grippers so that the sealing die, in turn, correctly positions the lid on the container to be closed.

The correctly positioned delivery of the lids is not always guaranteed, within the closing and sealing apparatus, in which the lid is pushed beneath the sealing die by means of a slide. In these known apparatuses, it can happen that the lid is aspirated to the sealing surface on the sealing die in a slightly displaced position. As a consequence, the containers are not correctly closed and become rejects.

SUMMARY OF THE INVENTION

It is the principal object of the present invention to provide a closing and sealing apparatus in which each lid is correctly positioned on a container and fused therewith.

It is another object of the present invention to provide a closing and sealing apparatus which is inexpensive and yet assures that each lid is correctly positioned on a container and fused therewith.

The foregoing objects, as well as others which are to become clear from the text below, are accomplished in accordance with the present invention by providing an improvement in an apparatus for closing and sealing filled containers with lids. The apparatus includes instrumentalities for positioning an individual lid beneath a sealing die having an underside. A lid is temporarily held and finally joined to a container under the influence of heat and pressure. A plurality of protuberances are disposed at the underside of the sealing die. Each of the protuberances has an oblique surface, each oblique surface having a point lying nearest a sealing surface defining an area of the underside. The area is substantially equal to that of the lid. As a consequence, each lid is correctly positioned on a respective container and becomes fused therewith.

It is a salient novel feature of the present invention that the lower surface (underside) of the sealing die is provided with protuberances, each having an oblique surface, and each oblique surface having a point which lies nearest to a sealing surface of the sealing die defined by an area of the lower surface which is equal to the area of a lid.

In the apparatus according to the invention, which is very simple, the lid slides along the oblique surfaces into the correct position on the sealing die during suction without further external action.

DETAILED DESCRIPTION OF THE PREFERRED EMBODIMENT

Figure 1:
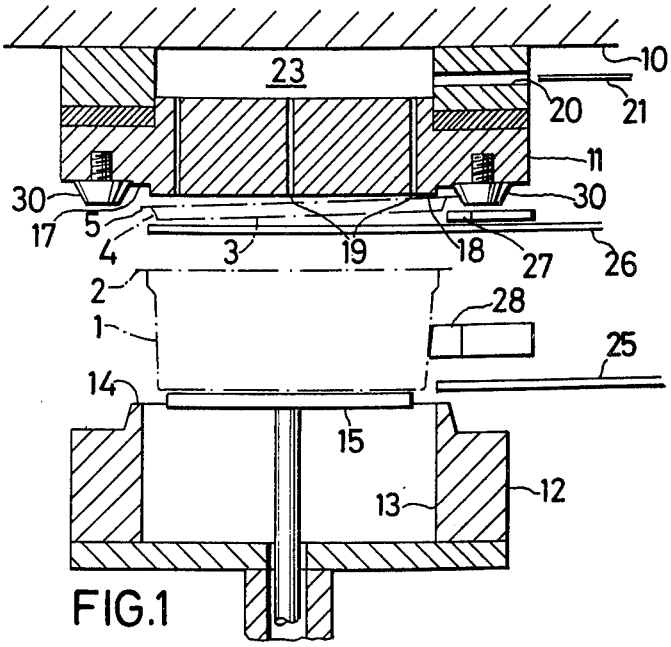
FIG. 1 is a cross-sectional view of a container closing and sealing apparatus according to an exemplary embodiment of the present invention, a container and lid being shown in phantom.
Figure 2:
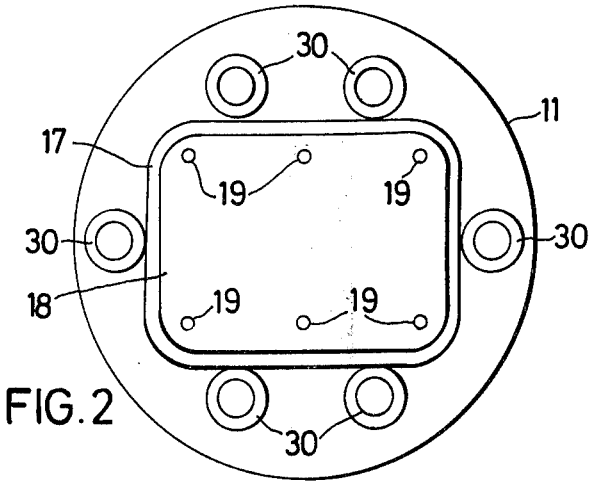
FIG. 2 is a plan view of the sealing surface of the sealing die used in the closing and sealing apparatus of FIG. 1.

As illustrated in FIGS. 1 and 2, an apparatus according to the present invention is arranged to close containers 1 made of thin aluminum foil. The containers have a protruding flange 2 at their open edge. The respective containers 1 are closed with a respective lid 3. Each lid 3 has an extrusion 4 fitting, as shown, into an opening of the container 1, and also has a flange 5 which is congruent with a flange 2 of the container 1.

The closing and sealing apparatus has several sealing mechanisms which rotate on a drum 10. Each of the sealing mechanisms has a fixedly installed, heated, sealing die 11 and a ring 12, which can be raised with respect to the sealing die 11. The ring 12 has a cylindrical void 13 in which may be placed a container 1 to be closed and sealed. The ring 12 has an upwardly pointing annular rim 14 which is congruent with the flange 2 of the container 1. A support plate 15 is disposed coaxially with ring 12.

A narrow sealing surface 17 of the sealing die 11 is congruent with the flange 5 of the lid 3 and it is provided with a step 18 which fits into the extrusion 4 of the lid 3. The underside (lower face) of the step 18 contains terminations of vacuum lines (bores) 19, which come from a chamber 23. The chamber 23 can be connected to a source of vacuum (not shown) through a lateral bore 20 and a line 21, shown somewhat diagrammatically.

Fastened to the underside of the sealing die 11 are six protuberances 30 whose form is that of a frustrated, downwardly pointing cone. The protuberances 30 are distributed along the outer edge of a narrow sealing surface 17, which is substantially rectangular as shown in the present exemplary embodiment, so that the wide base region of the protuberances 30 just touches the outer limit of the sealing surface 17, these tangent points limiting an area which is congruent with the surface area of the lid 3. Due to the frustrated, conical shape of the protuberances 30, the points nearest to the sealing surface 17 which lie on the small cross-sectional region of the protuberances 30 define an area similar in shape to that of the lid 3, but somewhat larger.

The protuberances 30, which have the shape of frustrated cones with a cone angle of approximately 60°, are equipped with a threaded stud 31 by means of which they can be screwed into the underside of the sealing die 11.

When the ring 12 is lowered, a space is formed between the ring 12 and the sealing die 11 and into this space extend guide members 25 and 26 for delivering the lid 3 and the container 1. Associated with the guide members 25 and 26 are rotating fingers 27 and 28, which extend into the above-described space during their rotation. The fingers 27 and 28 respectively push the lid 3 and the filled container 1 on and along the guides 25 and 26 into an orbital path of the sealing mechanism whereby the container 1 is placed on a support plate 15 and is carried along by it. As soon as the lid 3 has arrived under the sealing die 11, the chamber 23 and the vacuum lines 19 are connected with the vacuum source so that the lid 3 is moved to the step 18. Because the lids 3 are rarely delivered to the step 18 and to the sealing surface 17 in the correct spatial position, certain regions of the periphery of the lid 3 being moved are brought into contact with the oblique surface of one or more of the protuberances 30. When the flange 5 of the lid 3 glides along the oblique surfaces of the protuberances 30, the lid 3 is guided toward the sealing surface 17 so that in its final position, it is precisely positioned on the sealing surface 17 of the sealing die 11. This guarantees that, when the container 1 is raised up toward the sealing die 11, the lid 3 is placed on the container 1 in the correct position, and is sealed tightly to it under the influence of pressure and heat. After the vacuum is removed, and the ring 12 is lowered, the sealed container 1, 2, 3 is removed from the sealing mechanism.

It should be noted that instead of the frustrated cone-shaped protuberances, which have the surrounding oblique surface, protuberances of different shapes could be disposed at the sealing die 11 which would have an oblique surface only on that side facing the sealing surface 17.

It is to be understood that the foregoing description of an illustrative embodiment and the associated drawing figures have been set out by way of example. Numerous other embodiments and variants are possible within the spirit and scope of the invention, the scope being defined by the appended claims.

I claim:

1. In an apparatus for closing and sealing filled containers with lids which apparatus includes a sealing die having suction means for producing at least a partial vacuum within the sealing die and an underside surface against which a lid is temporarily held by the suction and finally joined to a container under the influence of heat and pressure, means for positioning an individual lid beneath the sealing die adjacent the underside surface and into the effective range of the suction thereby producing a displacement of the lid toward the underside surface, the improvement comprising a plurality of protuberances mounted to the underside surface of the sealing die for jointly, stationarily positioning a lid on said underside surface prior to sealing and during the displacement of the lid toward the underside surface due to the suction, each of said protuberances having an oblique surface, and each oblique surface having a point lying nearest a sealing surface defining an area of said underside surface, which area is substantially equal to that of a lid, whereby edges of a lid may contact the oblique surfaces and become correctly positioned on a respective container and become fused therewith.

2. An arrangement as defined in claim 1, wherein each of said protuberances has a substantially conical form.

3. An arrangement as defined in claim 2, wherein each of said protuberances is formed respectively by a threaded stud screwed into said sealing die.

4. An arrangement as defined in claim 1, wherein each of said protuberances has a frusto-conical form.

5. An arrangement as defined in claim 4, wherein each of said protuberances is formed respectively by a threaded stud screwed into said sealing die.

6. An arrangement as defined in claim 1, wherein each of said protuberances has a substantially conical form.

7. An arrangement as defined in claim 6, wherein each of said protuberances is formed respectively by a threaded stud screwed into said sealing die.

8. An arrangement as defined in claim 1, wherein each of said protuberances has a frusto-conical form.

9. An arrangement as defined in claim 8, wherein each of said protuberances is formed respectively by a threaded stud screwed into said sealing die.

* * * * *